US005355907A

United States Patent [19]

Hoeptner, III

[11] Patent Number: 5,355,907

[45] Date of Patent: Oct. 18, 1994

[54] AUTOMATIC DRAINING BACK FLOW PREVENTER FOR USE WITH HYDRANT

[76] Inventor: Herbert W. Hoeptner, III, 15085 Venetian Way, Morgan Hill, Calif. 95037

[21] Appl. No.: 71,108

[22] Filed: Jun. 4, 1993

Related U.S. Application Data

[63] Continuation-in-part of Ser. No. 885,646, May 19, 1992, Pat. No. 5,217,039, and a continuation-in-part of Ser. No. 884,774, May 18, 1992, Pat. No. 5,228,471.

[51] Int. Cl.[5] ..... E03R 1/10

[52] U.S. Cl. ..... 137/218; 137/307; 137/360

[58] Field of Search ..... 137/218, 307, 360

[56] References Cited

U.S. PATENT DOCUMENTS

| | | | |
|---|---|---|---|
| 196,384 | 10/1877 | Porteous . | |
| 519,728 | 5/1894 | McGowan . | |
| 1,786,357 | 12/1930 | Miller . | |
| 1,987,883 | 1/1935 | White et al. . | |
| 2,174,743 | 10/1939 | Groeniger . | |
| 2,580,199 | 12/1951 | Schmid . | |
| 2,598,488 | 5/1952 | Bart . | |
| 2,598,968 | 6/1952 | Boosey . | |
| 2,605,781 | 8/1952 | Schmid et al. . | |
| 2,664,096 | 12/1953 | Murdock et al. . | |
| 2,940,464 | 6/1960 | Moen . | |
| 3,017,896 | 1/1962 | Papacek . | |
| 3,155,107 | 11/1964 | Woodford . | |
| 3,158,170 | 11/1964 | Tubbs . | |
| 3,171,423 | 3/1965 | Dillon | 137/218 |
| 3,770,003 | 11/1973 | Uroshevich . | |
| 3,858,599 | 1/1975 | Carlson | 137/218 |
| 3,885,585 | 5/1975 | Carpentier . | |
| 3,952,770 | 4/1976 | Botnick | 137/218 X |
| 4,109,671 | 8/1978 | Hughes et al. . | |
| 4,117,856 | 10/1978 | Carlson | 137/218 X |
| 4,653,521 | 3/1987 | Fillman . | |
| 4,653,522 | 3/1987 | Fillman et al. . | |
| 4,658,852 | 4/1987 | Weingarten | 137/218 |
| 4,669,497 | 6/1987 | Tenhengel | 137/218 |
| 4,726,390 | 2/1988 | Franklin . | |
| 4,854,339 | 8/1989 | Hoeptner, III . | |
| 4,909,270 | 3/1990 | Enterante, Sr. et al. . | |
| 4,976,279 | 12/1990 | King, Sr. et al. . | |
| 5,033,500 | 7/1991 | Hoeptner, III . | |
| 5,094,261 | 3/1992 | Giacomini . | |
| 5,217,039 | 6/1993 | Hoeptner | 137/218 |
| 5,228,470 | 7/1993 | Lair et al. | 137/218 |
| 5,228,471 | 7/1993 | Hoeptner | 137/218 |

*Primary Examiner*—Gerald A. Michalsky
*Attorney, Agent, or Firm*—William W. Haefliger

[57] ABSTRACT

An automatic draining back flow prevention apparatus, for use with hydrant structure, comprising tubular body structure having main passage structure between flow entrance and exit ports; the body structure having a first side port communicating with the passage structure; diaphragm structure carried by the body structure to be exposed to flow in the passage structure; a stopper in the passage structure cooperating with the diaphragm structure to pass forward fluid flow from the hydrant structure, while the diaphragm structure is positioned to block exit flow of fluid through the first side port, and to block back flow of fluid through the main passage structure when the diaphragm structure moves to unblock flow of fluid through the first side port; a first seat in the body structure exposed to the passage structure, and seating the first diaphragm as it moves to block flow of fluid through the first side port; and spring structure carried by the body structure to urge the stopper toward the first diaphragm, the spring structure and first diaphragm sized to allow the movement of the diaphragm to pass forward fluid flow when the pressure of the flow exceeds a predetermined level.

10 Claims, 6 Drawing Sheets

AUTOMATIC DRAINING BACK FLOW PREVENTER FOR USE WITH HYDRANT

This application is a continuation-in-part of Ser. No. 885,646 filed May 19, 1992, now U.S. Pat. No. 5,217,039, and Ser. No. 884,774, filed May 18, 1992, now U.S. Pat. No. 5,228,471, the contents of which are incorporated herein by reference.

BACKGROUND OF THE INVENTION

The invention relates generally to fluid back flow prevention, and more particularly to a simple, effective, flow controller operating to allow drainage of fluid forward flow while back flow is prevented.

There is need for a simple, effective and reliable back flow preventing device, which also functions to discharge fluid accumulation in a line leading to the device. There is also need to minimize the possibility of freeze-up of fluid accumulation in such a device.

SUMMARY OF THE INVENTION

It is a major object of the invention to provide simple, effective flow control structure meeting the above needs. Basically, the device comprises:

a) tubular body means having main passage structure between flow entrance and exit ports, b) the body means having a first side port communicating with the passage structure, c) diaphragm means carried by the body means to be exposed to flow in the passage means, d) a stopper in the passage means cooperating with the diaphragm means to pass forward fluid flow from the hydrant structure, while the diaphragm means is positioned to block exit flow of fluid through the first side port, and to block back flow of fluid through the main passage means when the diaphragm means moves to unblock flow of fluid through the first side port, e) a first seat in the body means exposed to the passage means, and seating the first diaphragm as it moves to block flow of fluid through the first side port, f) and spring means carried by the body means to urge the stopper toward the first diaphragm, the spring means and first diaphragm sized to allow the movement of the diaphragm to pass forward fluid flow when the pressure of the flow exceeds a predetermined level.

Another object is to provide a body that includes a primary tubular section containing the spring, and a secondary tubular section containing the diaphragm in a bore defined by the secondary section, the primary tubular section having an outer diameter $D_1$, and the bore having a diameter $D_2$, where $D_2 >> D_1$.

A further object is to incorporate the apparatus in series with a hydrant structure, such as a wall hydrant in one application, and in series with a ground hydrant in another application.

These and other objects and advantages of the invention, as well as the details of an illustrative embodiment, will be more fully understood from the following specification and drawings, in which:

DRAWING DESCRIPTION

FIG. 1*a* is a vertical elevation taken in section showing elements of the wall hydrant form of the invention during forward flow of liquid, such as water, through the device, in a wall hydrant application;

FIG. 1*b* is a view like FIG. 1*a* showing elements of the FIG. 1*a* device during drainage;

FIGS. 2*a* and 2*b* are like FIGS. 1*a* and 1*b*, except that the device is applied to a ground (as for example "freeze") hydrant; and FIGS. 3*a* and 3*b* are similar to FIGS. 2*a* and 2*b*, except that the ground hydrant structure is modified.

DETAILED DESCRIPTION

Figure 1A:
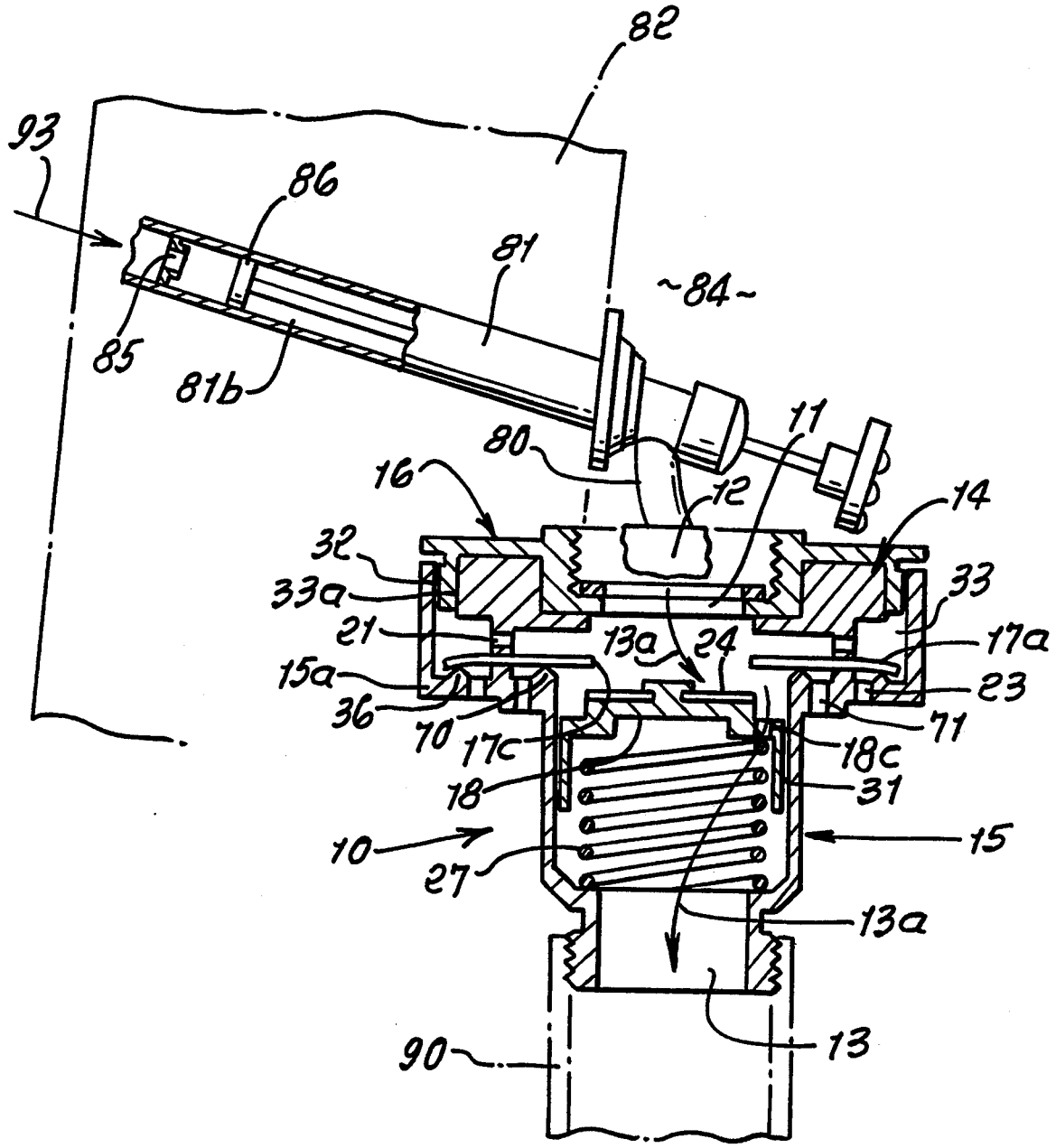
Figure 1B:
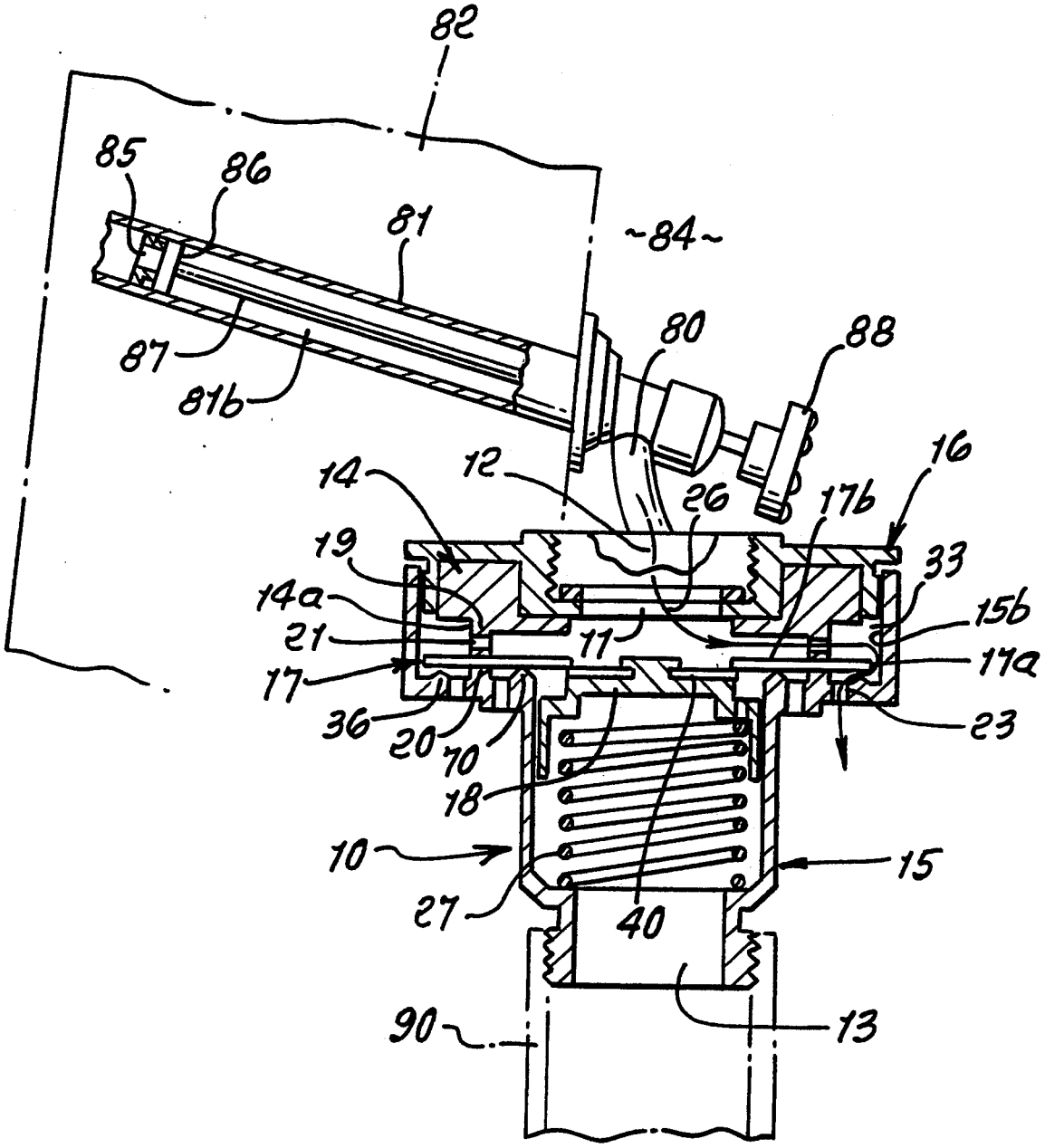

In FIGS. 1*a* and 1*b*, a tubular body means 10 has main through passage structure 11 between entrance and exit ports 12 and 13. The direction of forward fluid flow is indicated by arrow 13*a* in FIG. 1*a*. By way of example, the tubular body means may advantageously comprise a first tubular section 14, a second tubular section 15 and a third tubular section 16; and such sections may be assembled in telescoping relation, as in the manner shown, as at annular connection locations 31, 32 and 33*a*. A first flexible diaphragm 17 is carried by the body means to be exposed to flow in the passage means. Also, a stopper 18 is provided in the passage means to cooperate with the first diaphragm to pass forward fluid flow while the first diaphragm outer annular extent 17*a* flexes forwardly, as seen in FIG. 1 to block exit flow of fluid or liquid through a first side port 23, via an outer annular chamber 33, the stopper cooperating with the diaphragm in FIG. 1*b* to block back flow of fluid or liquid through the main passage when the diaphragm outer extent 17*a* moves to unblock exit flow of fluid through the first side port 23.

As shown, the first diaphragm is annular and may have its radially intermediate annular extent 17*b* retained between annular shoulder 19 formed by the first body section 14 and annular shoulder 20 formed by the second section 15.

Port 23 is adapted to communicate chamber 33 via passage 21 in annular wall 14*a* with the main passage structure 11 in the tubular body; however, when the diaphragm is flexed forwardly, as shown in FIG. 1*a*, it blocks exit flow of fluid from the main passage structure through the first side port or ports 23, by annular engagement with a seat or part 36 on enlargement 15*a* of section 15, and exposed to chamber 33, due to fluid pressure exertion on the diaphragm. Note that the stopper has an annular seat 24 thereon presented toward the diaphragm and positioned to annularly seat the first diaphragm as it moves to FIG. 1*b* position. Under these conditions, flow, as via arrow 13*a*, and holes 18*c* in the stopper, is cut off, and drainage flow passes through the passage 21, then to chamber 33 and outwardly through the exit port 23. See arrow 26 in FIG. 1*b*.

In FIG. 1*a*, flow pressure against the stopper displaces its outer extent downwardly against seat 36, to allow flow to pass through central opening 17*c* in diaphragm 17, a compression spring 27 in and carried by the second section 15 exerting upward return force on the stopper. That spring is compressed as the stopper is forced downwardly by flow pressure. The spring means 27 and diaphragm 17 are sized to allow movement of the diaphragm to pass fluid flow when the pressure of that flow exceeds a predetermined level, such as about 0.5 psi.

In accordance with an important aspect of the invention, the stopper 18 cooperates with the first diaphragm 17 to block back flow of fluid through the main passage means (flow pressure being reduced) when the first diaphragm moves upwardly in FIG. 1*b* and flexes to unblock exit flow of fluid through the first side port 23. See the exit flow arrow 26 in FIG. 1*b*. In this regard, a sealing disc 40 or equivalent support is provided on the stopper 18 to extend horizontally, i.e., normal to the flow, and to peripherally seat against the underside of the first diaphragm 17 as the stopper moves upwardly in FIG. 1*b*. The disc and central portion of the stopper then extend across the diaphragm central opening 17*d* to block the back flow of fluid through that opening. When the stopper is displaced downwardly, as in FIG. 1*a*, flow passes through stopper opening or openings 18*c* spaced radially outwardly of the disc. See flow arrow 13*a*.

In FIG. 1*b* the diaphragm outer portion 17*a* is shown as having moved upwardly off the seat 36 to allow drainage flow of fluid through the side port 23, as indicated by flow arrow 26.

FIGS. 1*a* and 1*b* also show the device attached to the tubular hose connection duct 80 integral with the inclined tubular hydrant housing or structure 81, near the lower end of the latter. The housing is installed in a wall 82, to extend to the outside 84 of the wall.

In FIG. 1*b*, a drain port 85 in the upper end of the housing 81 is closed, i.e., covered by a gate 86, on a valve stem 87, axially controlled by an external handle 88. The device 10 is in FIG. 1*b* mode, so that back flow from a fluid line 90 is blocked, and remaining liquid in the housing interior 81*b*, may flow out the side port 23, as referred to above.

In FIG. 1*a*, the device 10 is in liquid forward flow mode. Water flows from a line 93 at the inner side of wall 82, into the upper end of the housing, and about the gate 86, at the side thereof. Water then flows downwardly in 81*b* and sidewardly and downwardly in 80, to pass through device 10, to line 90. Gate 86 is opened away from drain port 85, in FIG. 1*a*. Excess back-pressure at 90 relative to pressure at 11 will create a differential tending to lift the diaphragm off seat 70, for discharging pressure below the diaphragm out second port 71. The underside of 14 acts as a stop for the diaphragm.

Figure 2A:
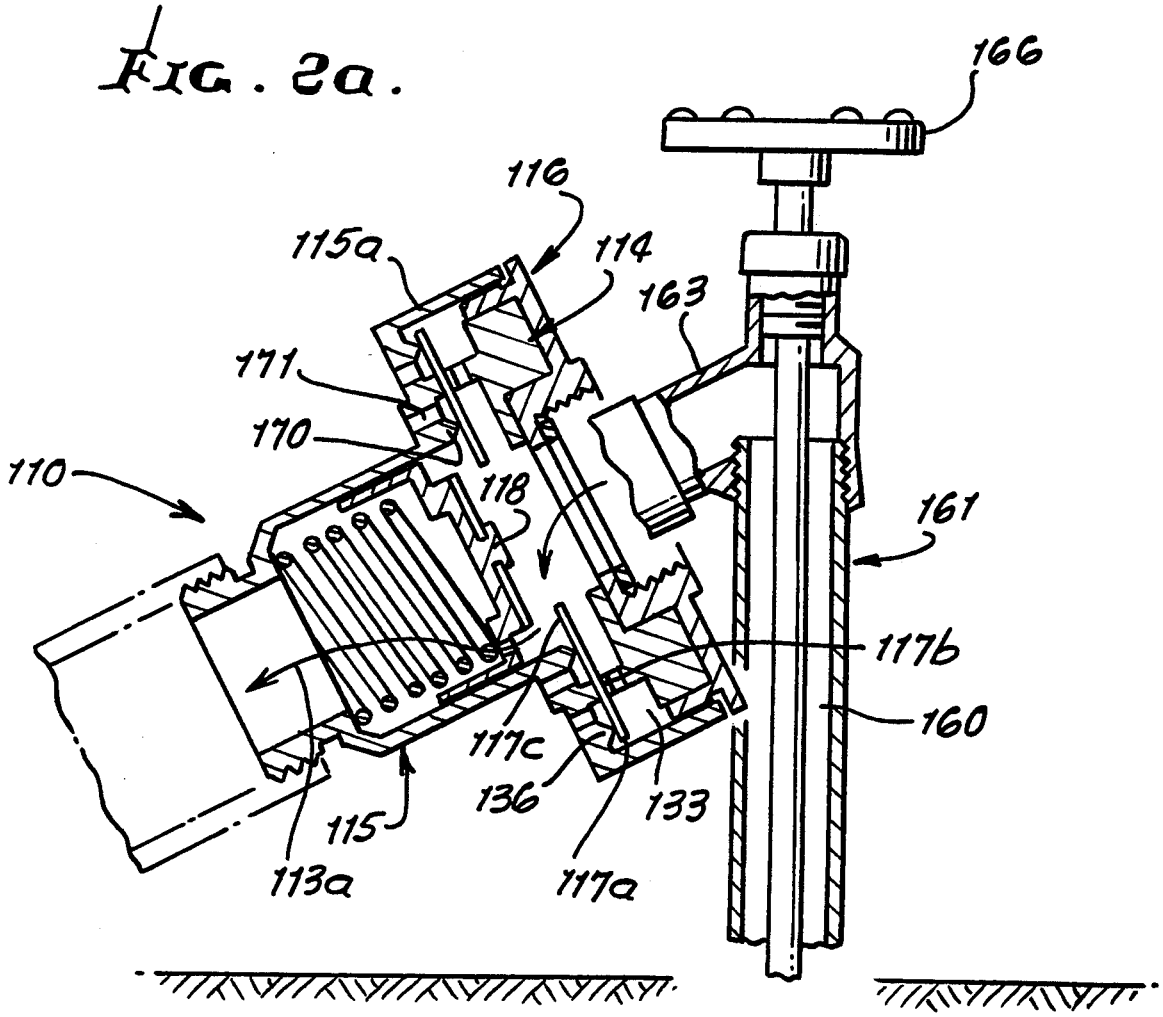
Figure 2A:
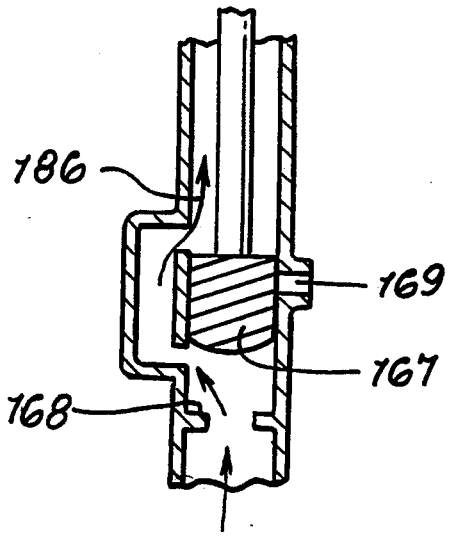

In FIGS. 1 and 2, the diaphragms are typically elastomeric, and the body parts are metallic or plastic.

It will also be seen that body (primary) section 15 contains the spring 27, and enlarged (secondary) section 15*a* contains the diaphragm 17 in a bore 15*b* defined by 15*a*. Primary section has an outer diameter $D_1$ and the bore 15*b* has a diameter $D_2$, where $D_2 >> D_1$. This enhances simplicity and reduces size of the device.

Figure 2B:
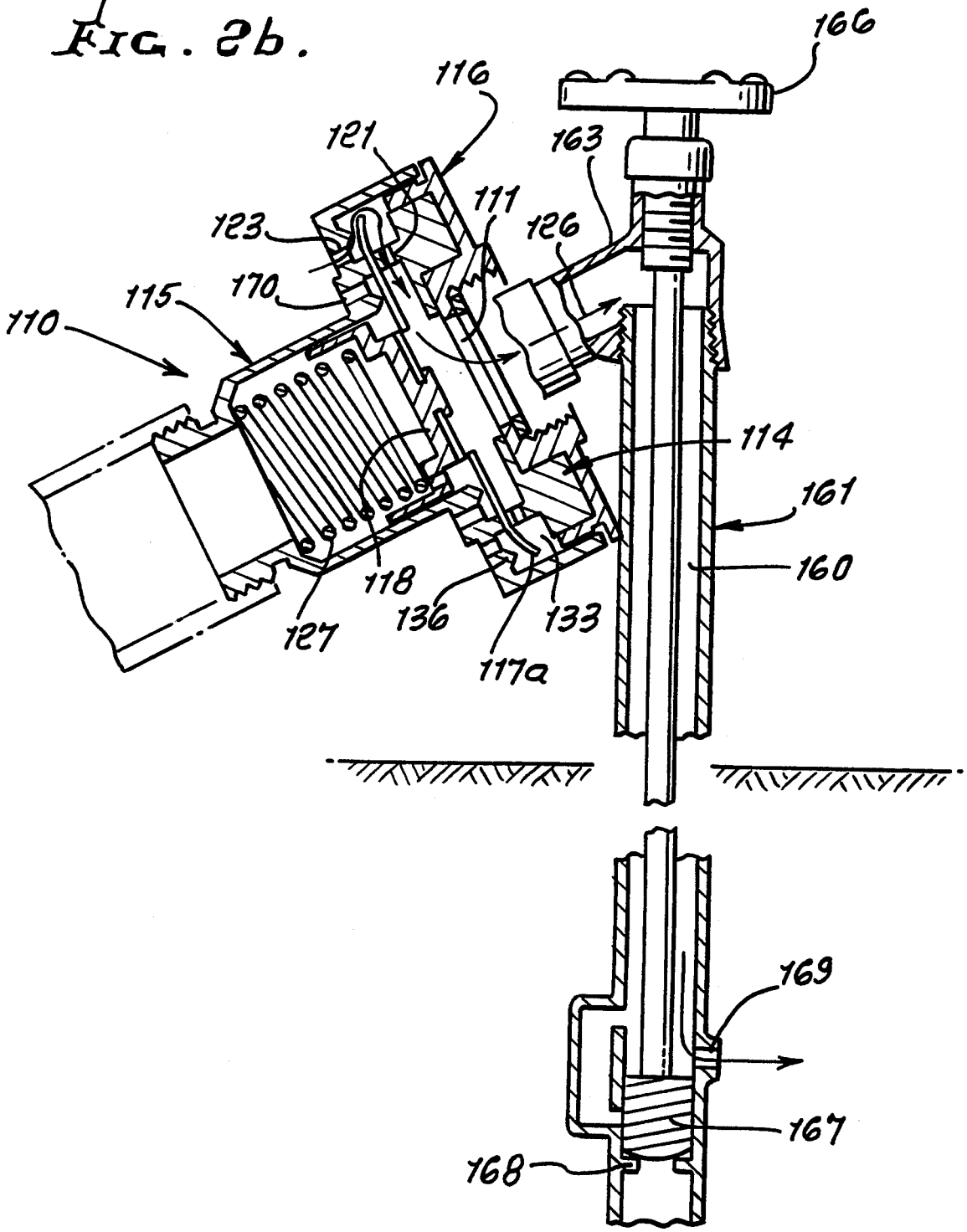

FIGS. 2*a* and 2*b* show a similar device in which corresponding elements bear the same numbers preceded by numeral 1. One difference is the location of the annular seat 136. In FIG. 2*a*, with flow passing through the tubular body means as indicated by arrow 113*a*, the radially outer portion 117*a* of the diaphragm seals, without flexing, against the annular seat 136. In FIG. 2*b*, with back flow through the tubular body means blocked (as in FIG. 1*b*), air can flow into the interior 160 of ground hydrant 161, in the manner and along the path indicated by arrow 126. In this case, the diaphragm outer annular portion 117*a* flexes away from seat 136, to allow air to inflow into chamber 133, and then through passage 121 into the main passage 111 of the body, to exit upwardly and laterally into the hydrant interior, via hydrant tubular side stem 163. Also, the diaphragm inner portion may be lifted off seat 170, to allow back-flow discharge out port 171.

Note that in FIG. 2*a*, the hydrant manual control 166 has been rotated to elevate plug stopper 167 away from lower seat 168, allowing fluid flow up through the hydrant. See arrow 186.

In FIG. 2*b*, the plug stopper has been depressed against seat 168 to stop such flow, and fluid back flows down through the hydrant casing and out the uncovered "weep" side port 169. The latter is sidewardly covered by the elevated stopper in FIG. 2*a*. Typically, air enters the hydrant body interior, via path 126 when pressure therein drops below a value less than 0.5 psi.

In each of the views, FIGS. 1*a* and 1*b*, and FIGS. 2*a* and 2*b*, the single diaphragm is retained radially medially so that it projects outwardly toward seat 36 or 136, and also projects inwardly across an annular seat 70 or 170, and then inwardly toward the upward path of the stopper. Diaphragm portions 17*a* and 17*c*, or 117*a* and 117*c*, may be considered as two diaphragms, pivoting at location 117*b*.

Figure 3A:
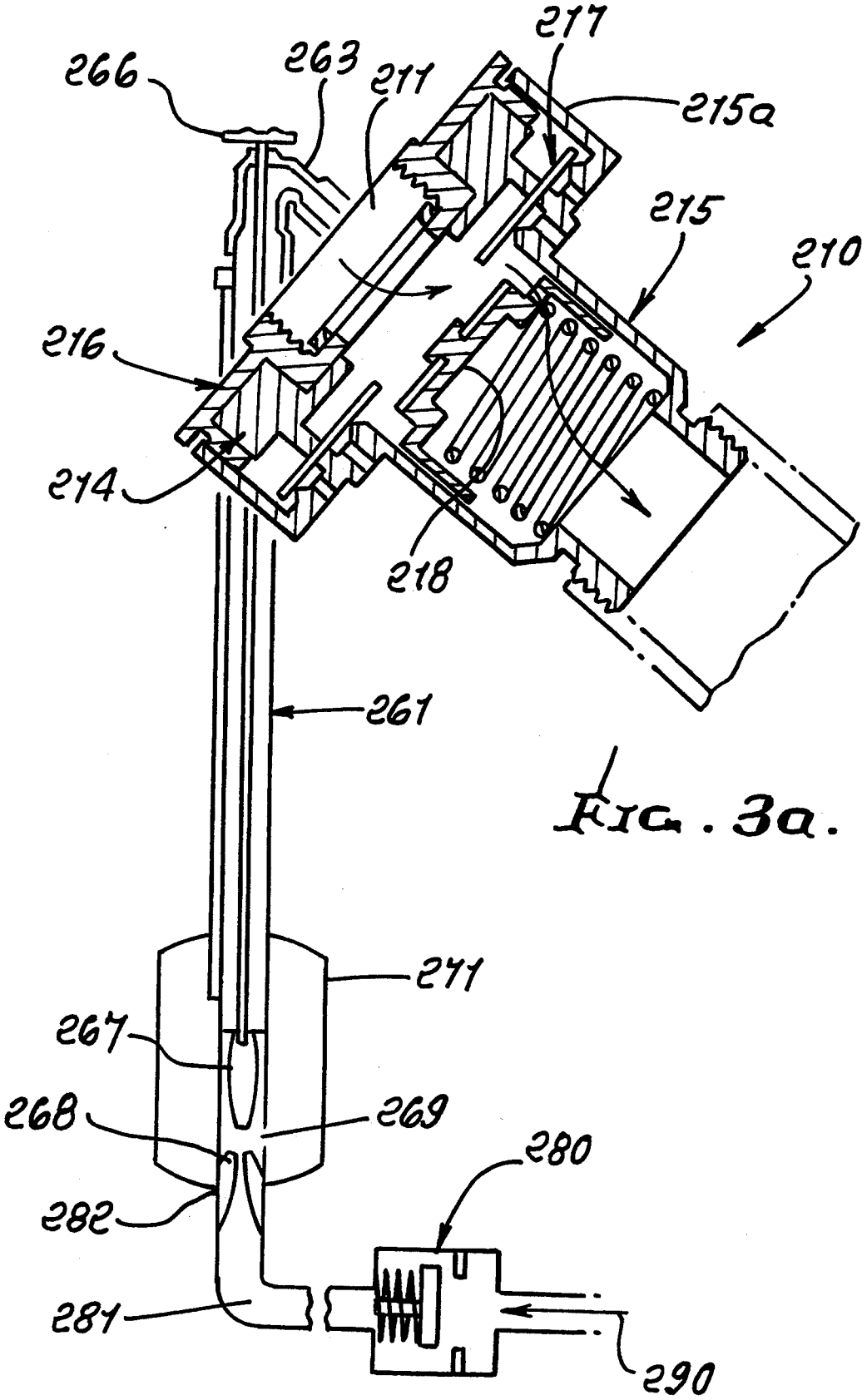
Figure 3B:
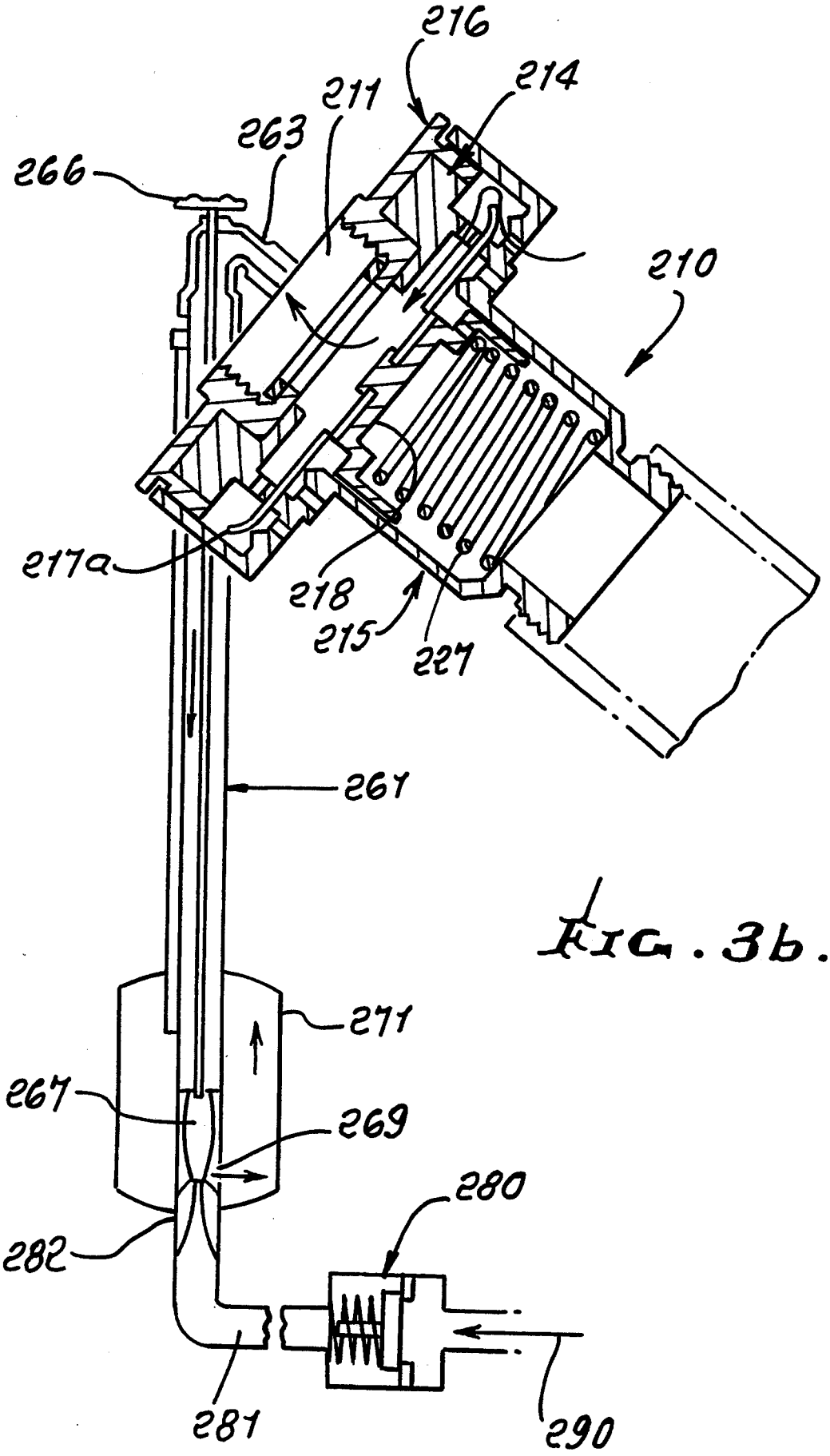

FIGS. 3*a* and 3*b* show the same apparatus, as related to the hydrant, as is seen in FIGS. 1*a* and 1*b*, respectively, and corresponding parts bear the same numbers, except that the first digit in FIGS. 2*a* and 2*b* is a "2" instead of "1". Operation is also the same.

The hydrant differs in that a check valve 280 is in series with the ducting 281 connected to the bottom 282 of the hydrant casing. Also, the check valve is opened by supply fluid pressure at 290, and fluid flows up the hydrant, as in FIG. 2*a*.

In FIG. 3*b*, the supply pressure is absent or very low, the check valve closes, and air may flow via the back flow preventer 210 down the hydrant casing and out the weep port 269 into a chamber 271 about the hydrant body. Stream line stopper and annular seat elements appear at 267 and 268.

I claim:

1. In automatic draining back flow prevention apparatus, for use with hydrant structure, the combination comprising:

a) tubular body means having main passage structure between flow entrance and exit ports, b) the body means having a first side port communicating with said passage structure, c) a single diaphragm carried by the body means to be exposed to flow in said passage means, d) a stopper in said passage means cooperating with said diaphragm to pass forward fluid flow from said hydrant structure, while the diaphragm is positioned to block exit flow of fluid through the first side port, and to block back flow of fluid through said main passage means when said diaphragm moves to unblock flow of fluid through said first side port, said diaphragm forming a central through opening, e) a first seat in said body means exposed to said passage means, and seating said diaphragm as it moves to block flow of fluid through said first side port, f) and spring means carried by said body means to urge the stopper bodily toward said diaphragm, said spring means and diaphragm sized to allow said movement of the diaphragm to pass forward fluid flow when the pressure of said flow exceeds a predetermined level, g) there being a second annular seat for said diaphragm, inwardly of said first seat, and allowing diaphragm flexing away from the second seat to allow fluid passage between the main passage and the exterior via a second port in said body, h) said stopper located downstream of said diaphragm in said direction of forward fluid flow through said central opening, i) the first port being at a greater radial distance from said central through opening than the second port.

2. The combination of claim 1 wherein said body includes a primary tubular section containing said spring, and a secondary tubular section containing said diaphragm in a bore defined by said secondary section, said primary tubular section having an outer diameter $D_1$, and said bore having a diameter $D_2$, where $D_2 >> D_1$.

3. The combination of claim 1 including:

f) hydrant structure in combination with said draining back flow prevention apparatus, said hydrant structure including an elongated tubular body defining an upper interior in communication with said main passage, g) said tubular body having a flow entrance port in communication with said upper interior of said hydrant structure elongated tubular body.

4. The combination of claim 3 including a control valve in said elongated tubular body interior, and a weep port toward which fluid drains away from said flow entrance port when the valve is closed.

5. The combination of claim 4 including an elongated stem extending in said hydrant tubular body, said valve having a valve stopper carried by said stem, and including a handle for the stem, outside said hydrant tubular body for moving the stopper in valve controlling relation and in weep port controlling relation, whereby the weep port is closed when the control valve is open to pass fluid to said flow entrance port of said tubular body means.

6. The combination of claim 3 wherein the hydrant body has a lower end, and including a check valve at the lower end of the hydrant body to control entrance of fluid into said lower end.

7. The combination of claim 1 including a second annular seat for the diaphragm, inwardly of said first seat, and allowing diaphragm flexing away from the second seat to allow fluid passage between the main passage and the exterior via another port in said body.

8. The combination of claim 1 including a second seat for said diaphragm, and a discharge port in said body for discharging back-flow of fluid when the diaphragm is lifted off said second seat by the stopper.

9. In automatic draining back flow prevention apparatus, the combination comprising:

a) tubular body means having main passage structure between flow entrance and exit ports, b) the body means having first and second side ports communicating with said passage structure, c) a diaphragm having first and second portions carried by the body means to be exposed to flow in said passage means, d) a stopper bodily movable in said passage means and cooperating with said diaphragm to pass forward fluid flow while the first diaphragm portion flexes to block exit flow of fluid through the first side port, and to block back flow of fluid through said main passage means when said first diaphragm portion moves to upwardly unblock exit flow of fluid through said first side port, e) the second diaphragm portion movable upwardly to allow release of back-flow pressure through the second side port when the stopper and diaphragm block back flow of fluid through the main passage means, f) said diaphragm forming a central through opening, said stopper located downstream of said diaphragm central through opening in said direction of forward fluid through said opening, there being spring means urging the stopper toward said diaphragm, said first and second side ports located outwardly of said central through opening, the first port being at a greater radial distance from the central opening than the second port.

10. The combination of claim 9 wherein said two diaphragm portions are generally in the same plane.

* * * * *